US011412869B2

(12) United States Patent
Martin

(10) Patent No.: US 11,412,869 B2
(45) Date of Patent: Aug. 16, 2022

(54) FLAT-FOLD FITTED SHEET

(71) Applicant: Wendy Ilene Martin, Clifton, VA (US)

(72) Inventor: Wendy Ilene Martin, Clifton, VA (US)

( * ) Notice: Subject to any disclaimer, the term of this patent is extended or adjusted under 35 U.S.C. 154(b) by 200 days.

(21) Appl. No.: 16/942,809

(22) Filed: Jul. 30, 2020

(65) Prior Publication Data

US 2022/0031097 A1 Feb. 3, 2022

(51) Int. Cl.
*A47G 9/02* (2006.01)

(52) U.S. Cl.
CPC ..... *A47G 9/0246* (2013.01)

(58) Field of Classification Search
CPC ..... A47G 9/0246; A47G 9/0238; A47G 9/02; A47G 9/0223; Y10T 24/3913; Y10T 24/3958
See application file for complete search history.

(56) References Cited

U.S. PATENT DOCUMENTS

| | | | | |
|---|---|---|---|---|
| 1,359,526 | A | 11/1920 | Ray | |
| 2,662,233 | A | 12/1953 | Cheesman | |
| 4,777,677 | A | 10/1988 | Dugan | |
| 5,046,207 | A | 9/1991 | Chamberlain | |
| 6,804,844 | B2 | 10/2004 | Cushing | |
| 6,921,202 | B2 | 7/2005 | Raterman | |
| 8,015,636 | B2 | 9/2011 | Briganti | |
| D670,125 | S | 11/2012 | Agarwall | |
| 8,561,235 | B2 | 10/2013 | Oh et al. | |
| 8,756,730 | B2 | 6/2014 | MacDonald | |
| D708,869 | S | 7/2014 | Mun | |
| 9,510,698 | B1 * | 12/2016 | Krotova | A47G 9/0246 |
| 2007/0151028 | A1 | 7/2007 | Bauer | |
| 2008/0028522 | A1 * | 2/2008 | Atwood | A47G 9/0246 5/497 |
| 2015/0026887 | A1 | 1/2015 | Taylor | |
| 2016/0081497 | A1 | 3/2016 | Keinings | |

FOREIGN PATENT DOCUMENTS

| | | |
|---|---|---|
| CN | 202060360 U | 12/2011 |

* cited by examiner

*Primary Examiner* — Peter M. Cuomo
*Assistant Examiner* — Adam C Ortiz
(74) *Attorney, Agent, or Firm* — Patricia C. Brzostowicz; Superior Patent Group, LLC

(57) ABSTRACT

Disclosed is a flat-fold fitted sheet with elastic around the entire perimeter, allowing it to fit snugly to the mattress yet fold easily in its open form. The flat fold fitted sheet includes a string attached to the elastic, which provides a means for releasing the elastic into the casing to achieve the flat form and a means of pulling the elastic out of the casing to resume the fitted form. In the fitted form, the elastic is tethered at the corners and excess string is wound around a spindle, which may be contained in a pocket when the sheet is in use. Zippers on each corner provide traditional pockets that fit snugly to the mattress when in the fitted form but enable the sheet to lay flat when in the open position. When both zippers and elastic are in the open position, the sheet lays completely flat and is therefore easy to fold and store.

20 Claims, 10 Drawing Sheets

FLAT-FOLD FITTED SHEET

FIELD

This disclosure relates to the field of fabric bedding, specifically a fitted sheet designed to fit a mattress in a snug manner yet fold flat.

BACKGROUND

Bed sheets designed to fit over mattresses come in roughly two different types. There are fitted sheets, generally with elastic around the edges, that are designed to fit the mattress snugly, and flat sheets that fit over the fitted sheets and are designed to be tucked under the bottom of the mattress on one end and lay atop it loosely. Having no elastic, flat sheets fold easily into compact form. Fitted sheets however, having elastic that bunches up the edges, are not easily folded into a flat, compact form and are difficult to fold and store.

Others have sought to solve this problem in various ways. U.S. Patent Application published in document US20160081497A1 by Keinigs disclosed a corner zip sheet. U.S. Patent Application published in document US20150026887A1 by Taylor also features zippered corners. U.S. Pat. No. 5,046,207A uses a single strand of elastic to draw a sheet around a mattress. Still no efficient means for providing a compact flat-fold fitted sheet that makes a snug fit over a mattress has been seen in a robust fashion in the marketplace.

SUMMARY

The disclosed article is a flat-fold fitted sheet that solves the problem associated with folding a traditional, fitted sheet with fixed elastic around the edges of all four sides. The disclosed flat-fold fitted sheet may be a piece of fabric having the shape of a polygon with twelve sides, wherein the polygon is a concave dodecagon having four internal angles of 270° each and eight internal angles of 90° each, having two sets of two equal length sides, and another set of eight sides of equal length that may have at least four zippers, a casing on each of the two sets of two sides, at least one span of an elastic band threaded through each span of casing, at least one span of non-elastic string with each end attached to ends of an elastic band to form a closed loop, at least two means to secure the ends of the elastic band at at least two of the corners, and at least one means of housing the string at at least one of these corners when the elastic band is drawn into a closed position.

The flat-fold fitted sheet may further comprise a second span of elastic banding and a second span of non-elastic string. The flat-fold fitted sheet may further comprise an additional means to house the string in the closed position. The flat-fold fitted sheet may further comprise one or two additional means to secure the ends of the second span of elastic banding at at least two corners. The flat-fold fitted sheet may comprise a means to house the string attached to the elastic when the elastic is drawn into the closed position, wherein the means is a spindle. The means to house the string may alternately be a retractable device. The flat-fold fitted sheet may further comprise a pocket or other means to house the string, spindle, or retractable device. The flat-fold fitted sheet may further comprise tabs on the edges of the two sets of two sides.

The flat-fold fitted sheet may further be described wherein the zippers are fitted to four pairs of the set of eight sides and temporarily attach one side of the pair to the other. The flat-fold fitted sheet may further comprise a housing to contain the elastic band and/or non-elastic string. The string may attach to each of two segments of elastic banding and may be long enough such that it threads through the casing of two adjacent sides thereby connecting the segments of elastic banding. At the opposite ends, the segments of elastic band may then be anchored to the far ends of the casing by stitching them into the seams alongside the zippers of the adjacent corners.

In another embodiment, the disclosure may include a flat-fold fitted sheet comprising: a piece of fabric formed from a rectangular shaped span having four sides, two of which are longer, wherein the corners have been removed to form a concave dodecagon with four interior angles of 270° each and eight internal angles of 90° each; four zippers that serve to temporarily attach edges where the corners were removed; casing on each of the four sides; a span of elastic cord or banding threaded through each of the casings and attached at one end to the sheet and the other end to a non-elastic string; a second means to secure the elastic cord or banding when the sheet is in the closed position; and a means to house the string when the elastic cord(s) or banding is drawn into a closed position.

The flat-fold fitted sheet may further comprise tabs on the edges of the two sets of two sides. The flat-fold fitted sheet may comprise an alternate means of holding the elastic in place when in the drawn position, wherein the means to secure the ends of the elastic cord is a clasp closure. The flat-fold fitted sheet may comprise a separate housing device that serves as a connector and/or housing for the joined ends of the elastic and string.

Disclosed is a flat-fold fitted sheet with elastic around the entire perimeter, allowing it to fit snugly to the mattress yet fold easily in its open form. The flat fold fitted sheet includes a string attached to the elastic, which provides a means for releasing the elastic into the casing to achieve the flat form and a means of pulling the elastic out of the casing to resume the fitted form. In the fitted form, the elastic is tethered at the corners and excess string is wound around a spindle, which may be contained in a pocket when the sheet is in use. Zippers on each corner provide traditional pockets that fit snugly to the mattress when in the fitted form but enable the sheet to lay flat when in the open position. When both zippers and elastic are in the open position, the sheet lays completely flat and is therefore easy to fold and store.

Before explaining the disclosed embodiments of the present disclosure in detail, it is to be understood that the disclosure is not limited in its application to the details of the particular arrangement shown, since the disclosure is capable of other embodiments. Also, the terminology used herein is for the purpose of description and not of limitation.

DETAILED DESCRIPTION

Figure 1:
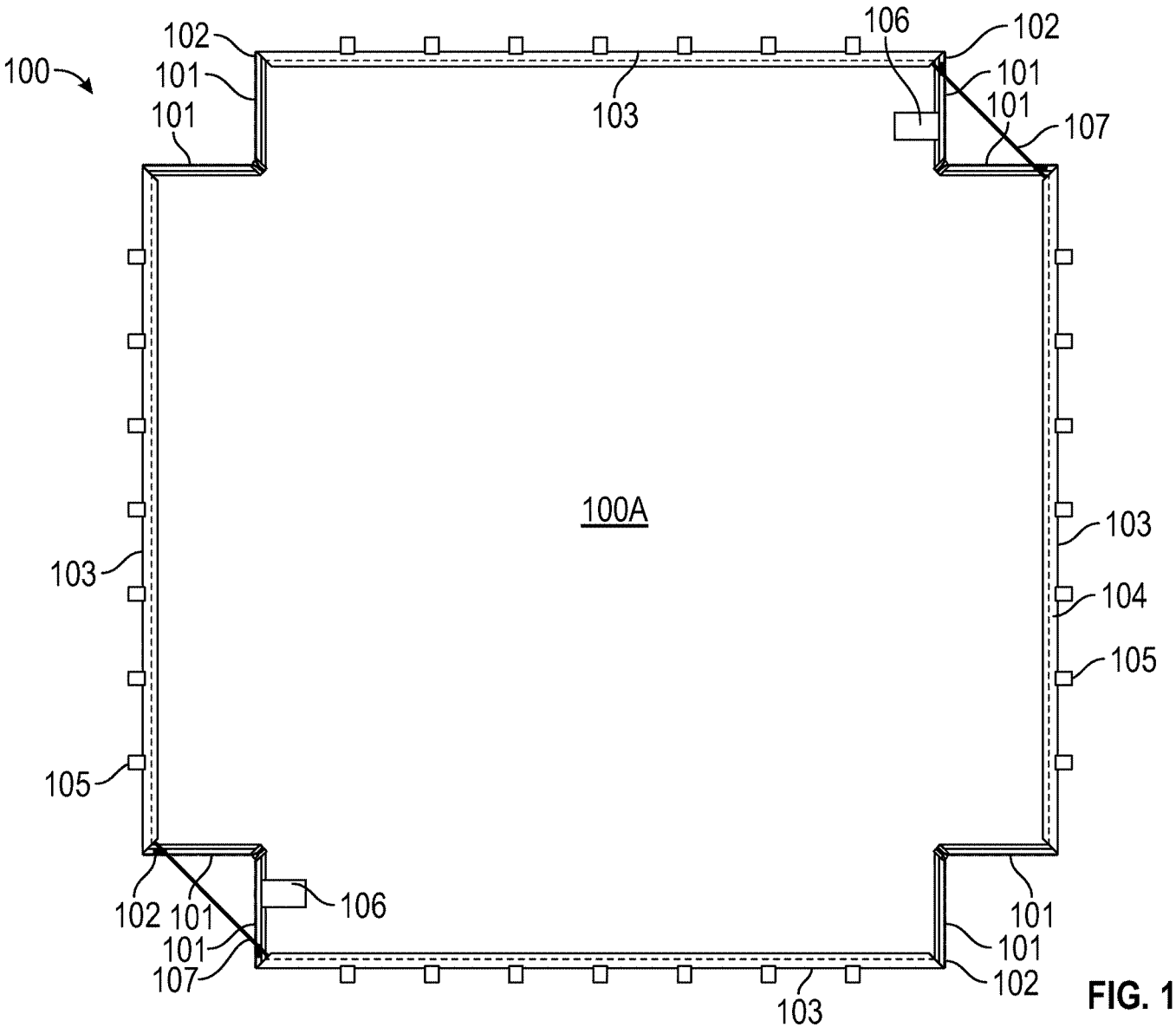
FIG. 1 is a perspective view of the underside of the flat-fold fitted sheet.

FIG. 1 shows a perspective view of the underside 100A, being the side to face and abut the mattress, of the flat-fold fitted sheet 100 of the present disclosure in the open position. The sheet 100 comprises a piece of fabric having twelve sides. The fabric may be chosen from natural or synthetic fibers, or blends of natural and synthetic fibers, examples being cotton, wool, polyester, knit, flannel, bamboo, silk, or any other material being any pattern and color desired. The shorter sides 101 are each fitted with one side of a zipper 102 such that they may be connected. Other types of semi-permanent connecting devices may be envisioned including but not limited to Velcro, ties, snaps, and buttons. The zipper 102 may be plastic or metal and be attached to the sheet fabric via sewing or stitching whether by hand or by machine. Folded and sewn longer edges 103 may form a casing 104 to hold elastic cord or banding (now shown). Alternately, a different panel of fabric may be used to form the casing 104 by attaching the casing fabric to the sheet fabric via stitching or sewing. Tabs 105, being made of the same fabric as the sheet 100 or a different fabric and/or pattern and color, may be sewn on these longer edges to increase ease of folding and/or pulling the elastic through the casing 104. At least one or two pockets 106, being made from a same or different fabric as the sheet 100, may be provided to hold extra string 107 when the flat-fold fitted sheet 100 is in the closed position. The string 107 is partially housed in the casing 104 when the sheet 100 is in the open position. In FIG. 1, the sheet 100 is in the flat or open position ready to be folded for storage. The string 107 is partially exposed when the sheet is in the open position. String may span between elastic banding (not shown) that is threaded through the casing 104 at at least one corner, or at least two corners, or at least three corners, or at least four corners. In the embodiment shown in FIG. 1, string 107 spans between elastic banding of two opposite corners, being catty-corner or diagonal to one another. One may envision various design options.

Figure 2:
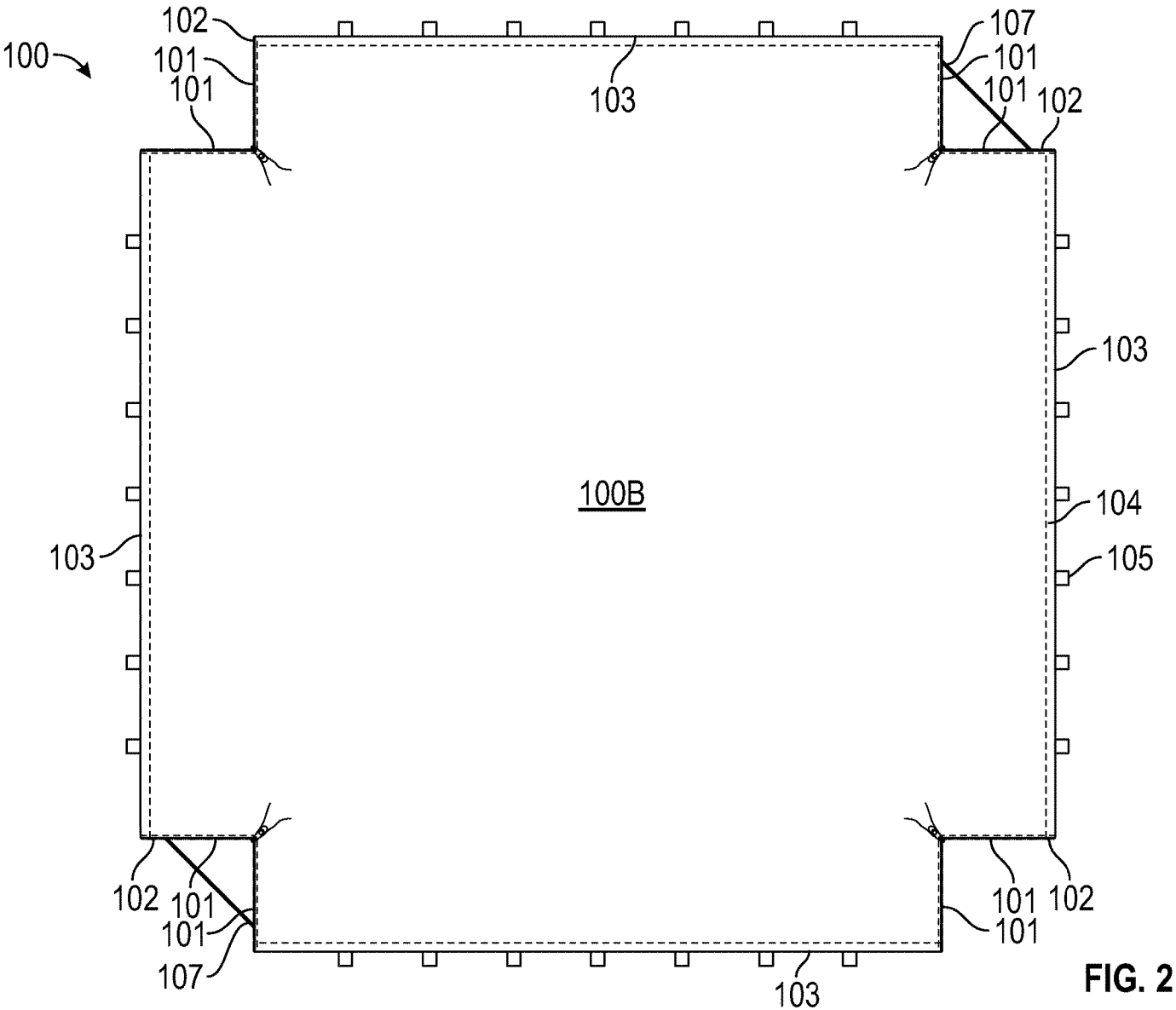
FIG. 2 is a perspective view of the top side of the flat-fold fitted sheet.

FIG. 2 is a perspective view of the top side 1008 of the flat-fold fitted sheet in the flat or open position. As shown in FIG. 2, the short sides 101 have zippers 102 attached thereto. Zippers 102 shown in FIG. 2 are in the open position allowing for easy folding of the sheet. The long sides 103 may have tabs 105 for ease of folding and/or pulling the elastic through the casing. The string 107 reaches between at least one or at least two of the short sides 101. The string 107 is partially exposed when the sheet is in the open position. String may span between elastic banding (not shown) that is threaded through the casing 104 at at least one corner, or at least two corners, or at least three corners, or at least four corners. In the embodiment shown in FIG. 2, string 107 spans between elastic banding of two adjacent short sides 103 at two opposite or catty-corner corners. One may envision various design options.

Figure 3:
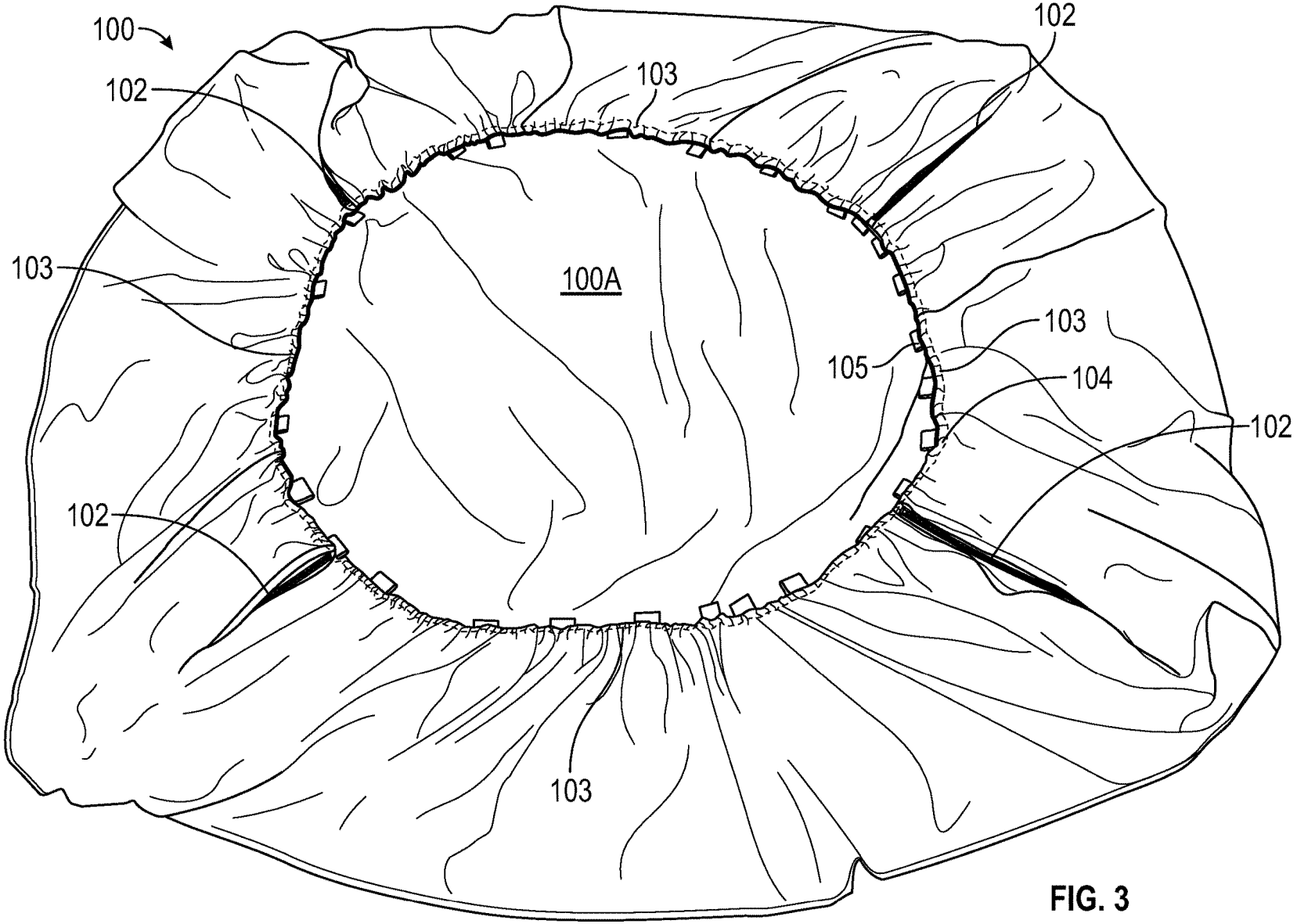
FIG. 3 is a perspective view of the underside of the flat-fold fitted sheet with elastic drawn.
Figure 4:
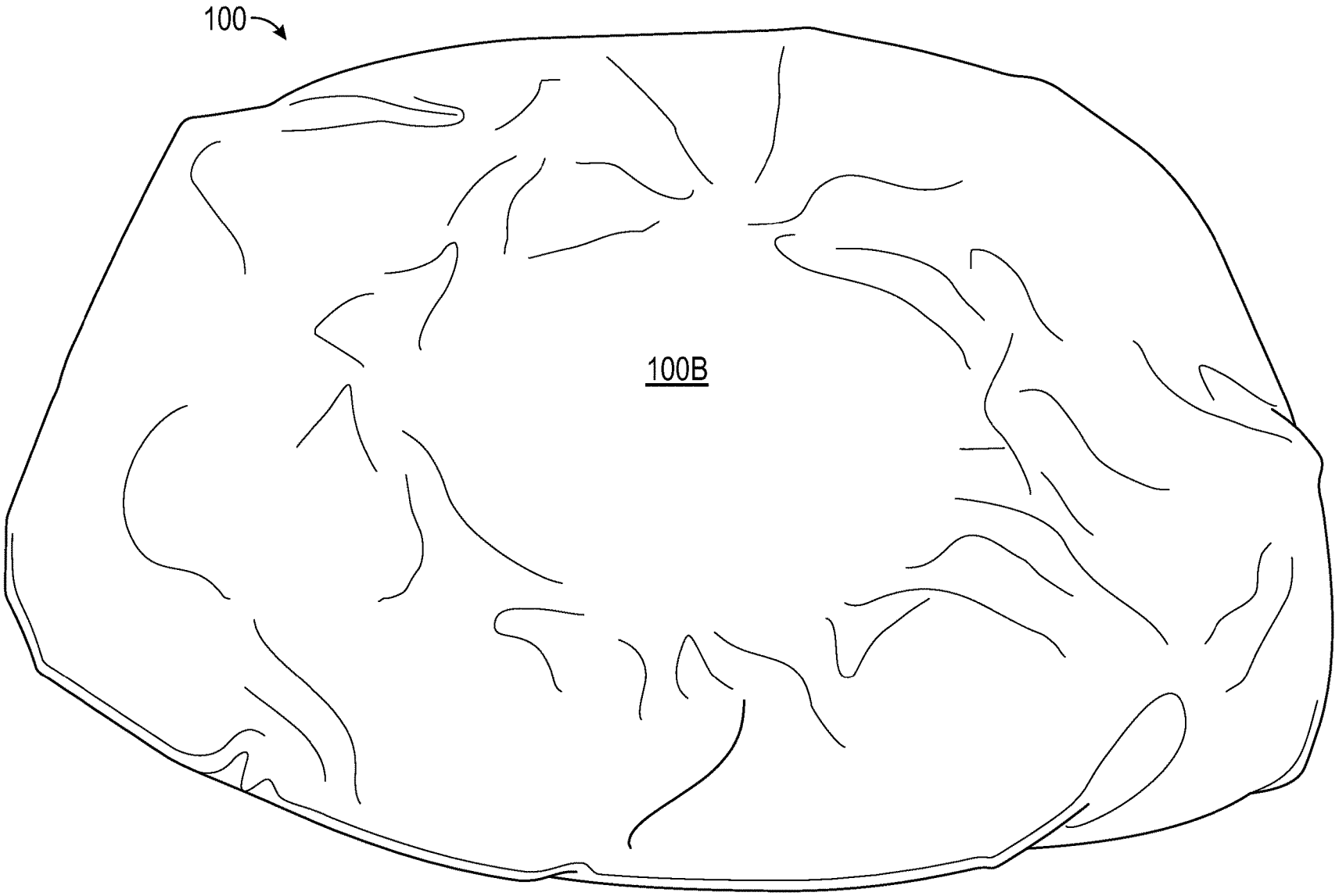
FIG. 4 is a perspective view of the top side of the flat-fold fitted sheet with elastic drawn.

FIG. 3 is a perspective view of the underside 100A of the flat-fold fitted sheet 100 in the drawn or closed position. With zippers 102 on the short sides closed and elastic drawn, the sheet may fit snuggly over a mattress. Casing 104 holds the elastic (not shown) and tabs 105, being spaced equally or not equally, are affixed to the long edges 103. At least one tab, or at least two tabs, or at least three tabs, or more, may be affixed to each long edge or side 103. FIG. 4 is a perspective view of the top side 1008 of the flat-fold fitted sheet 100 in the drawn or closed position, ready to be fitted onto a mattress. The flat-fold fitted sheet 100 may be made with any dimensions to fit any size mattress, whether a crib mattress, twin bed, double, queen, king, or California king, or any other dimensions of a mattress. It can be conceived that the flat-fold fitted sheet may also serve other purposes such as fitting over furniture or a box or other object having at least two sides, or at least four sides, or at least six sides, or at least eight sides, or at least twelve sides, or more. The sheet 100 may serve as a cover to protect objects from dust or water if made from a water resistant or proof fabric.

Figure 5:
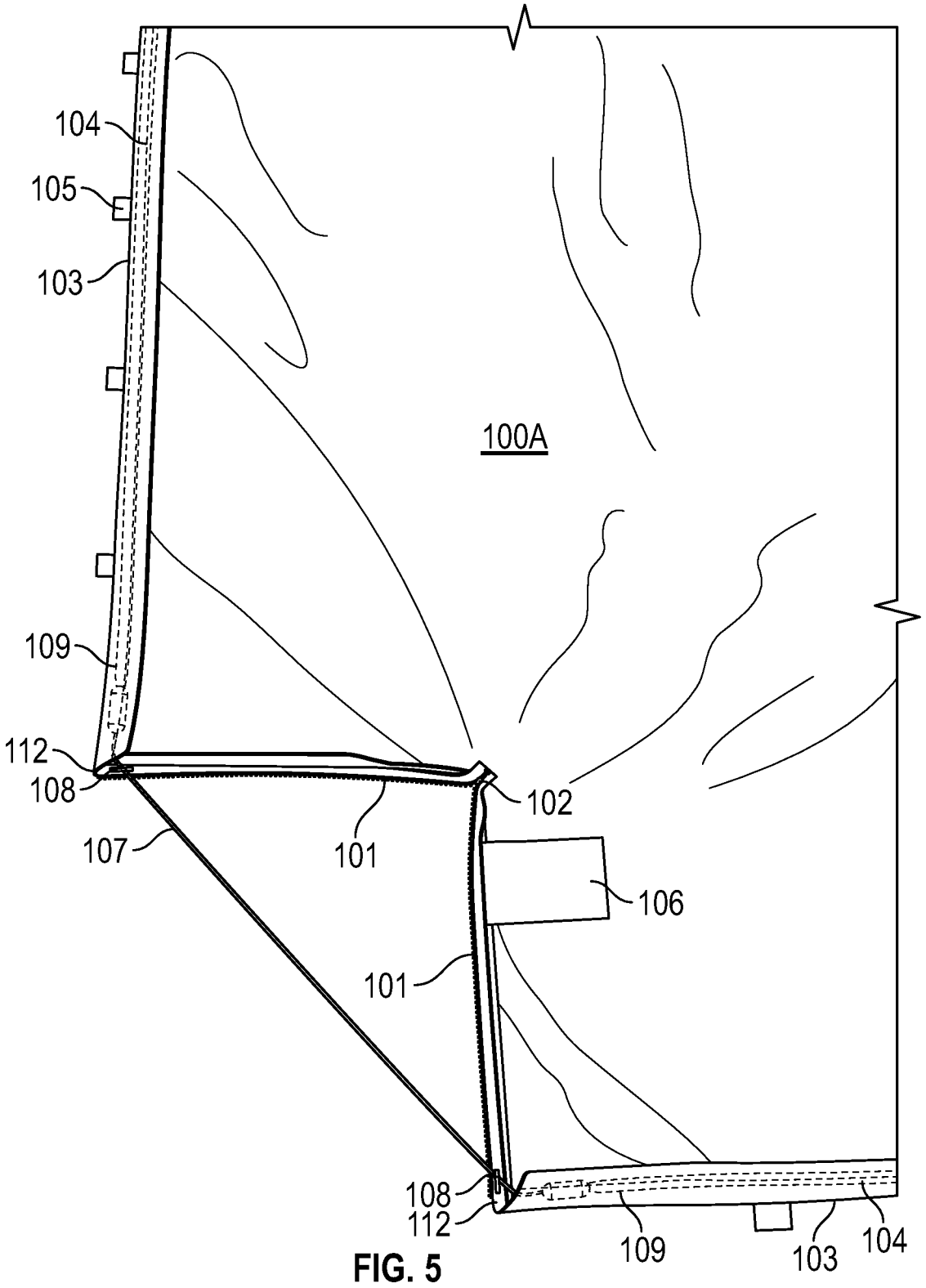
FIG. 5 is a close-up view of a corner of the underside of the flat-fold fitted sheet in a partially open position.

FIG. 5 illustrates the design of one corner of the underside 100A of the flat-fold fitted sheet 100 in the open position. This corner is an example corner wherein string 107 spans between elastic 109 that lies mostly inside the casing 104. Long sides 103 have casings 104 for the elastic 109 and string 107. The long sides 103 may have tabs 105 attached thereto. Short sides 101 have mating edges of zippers 102 attached thereto. String 107 attached to the elastic 109 draws the elastic 109 out of the casing 104 and draws the sheet into the closed position when you wish to fit the sheet over a mattress. To increase the ease with which the elastic 109 may be pulled by the string 107 through the casing 104, a capsule device 112 may be used over the joined ends of the elastic 109 and string 107. A clasp 108 may hold or tether the elastic 109 in place. The elastic 109 and a portion of the string 107 retracts into the casing 104 when the sheet is in the flat open position as shown in FIG. 1. The string 107, being a cord-like structure, may be made from any material, whether fabric, natural, synthetic, or blend, or polymer or plastic. The string 107 differs from the elastic in that it is essentially non-elastic, having little or low stretch ability. A clasp 108, or other semi-permanent attachment device 108 on at least one, or at least two corners formed by a short side 101 and a long side, 103 holds the free end of elastic 109 in place when the elastic is drawn and the sheet 100 is in the closed position. In the embodiment shown in FIGS. 1-5 string-elastic junctions and clasps 108 are designed on two opposing corners. It may be envisioned that various structures or means can serve as anchors, such as clasps, lobster claws, snaps, Velcro, or even a loop tied using the string, itself, to hold the elastic 109 in the closed position. Further, these means may include a button, clasp, buckle, latch, or hook. The elastic 109 may be a cord, fiber, string, or woven or braided elastic with varying strength or elasticity so as to hold the sheet to the mattress snugly such that the sheet does not move to a great extent in reference to the mattress while in use. In one embodiment at least one of the corners where the short sides 101 and the long sides 103 meet will have this design wherein the string 107 may be used to draw the elastic 109 tight, and the elastic 109 will be tethered by the clasp 108. The clasp serves this purpose here since the clasp has a smaller opening than the capsules 112 and therefore the capsule 112 will not be able to retract through the clasp. In yet another embodiment two of the corners where the short sides 101 and long sides 103 meet will have this design with clasps 112 attached thereto. Tabs 105 aid in pulling the elastic through the casing when transforming the sheet into the closed position. A pocket 106 may be included to house the string 107 when in the closed position.

Figure 6:
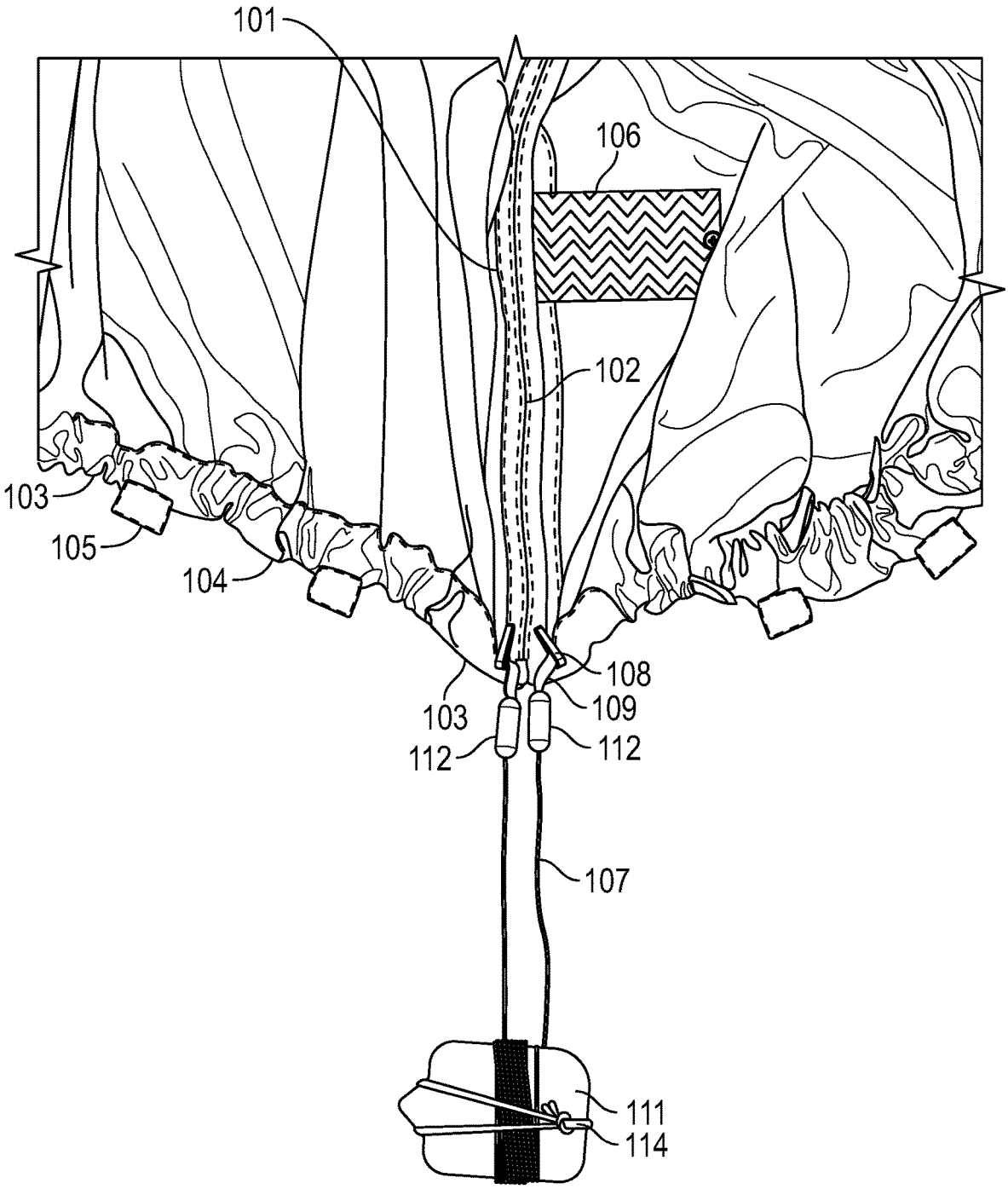
FIG. 6 is a close-up view of a corner of the underside of the flat-fold fitted sheet in a closed position with elastic drawn.

FIG. 6 more closely illustrates how the elastic may be tethered to the corner of the short edges 101. Here the underside of the sheet is shown with zipper 102 closed. Elastic is housed in the casing 104 lying on the long sides 103 of the sheet. Tabs 105 may be attached on the long sides of the sheet 103. A clasp 108, being metal, plastic, or other appropriate material, may be attached to the sheet via sewing or any other semi-permanent or permanent manner. The clasp 108, may be attached near the zipper 102, and hold the capsule 112 in place while the elastic 109 is in the drawn, or closed, position and allow the flat-fold fitted sheet to fit snugly on the mattress. As stated above, one may envision many means for semi-permanent attachment of the loose end of elastic 109 to be fastened to the sheet via snap, button, hook, or any other means of semi-permanent attachment. The extra string 107 may be wrapped partially or wholly around a spindle 111 to keep the string 107 from tangling and for storage of the string 107. A tie or spindle cord 114 may be employed to hold the string in place.

Figure 7:
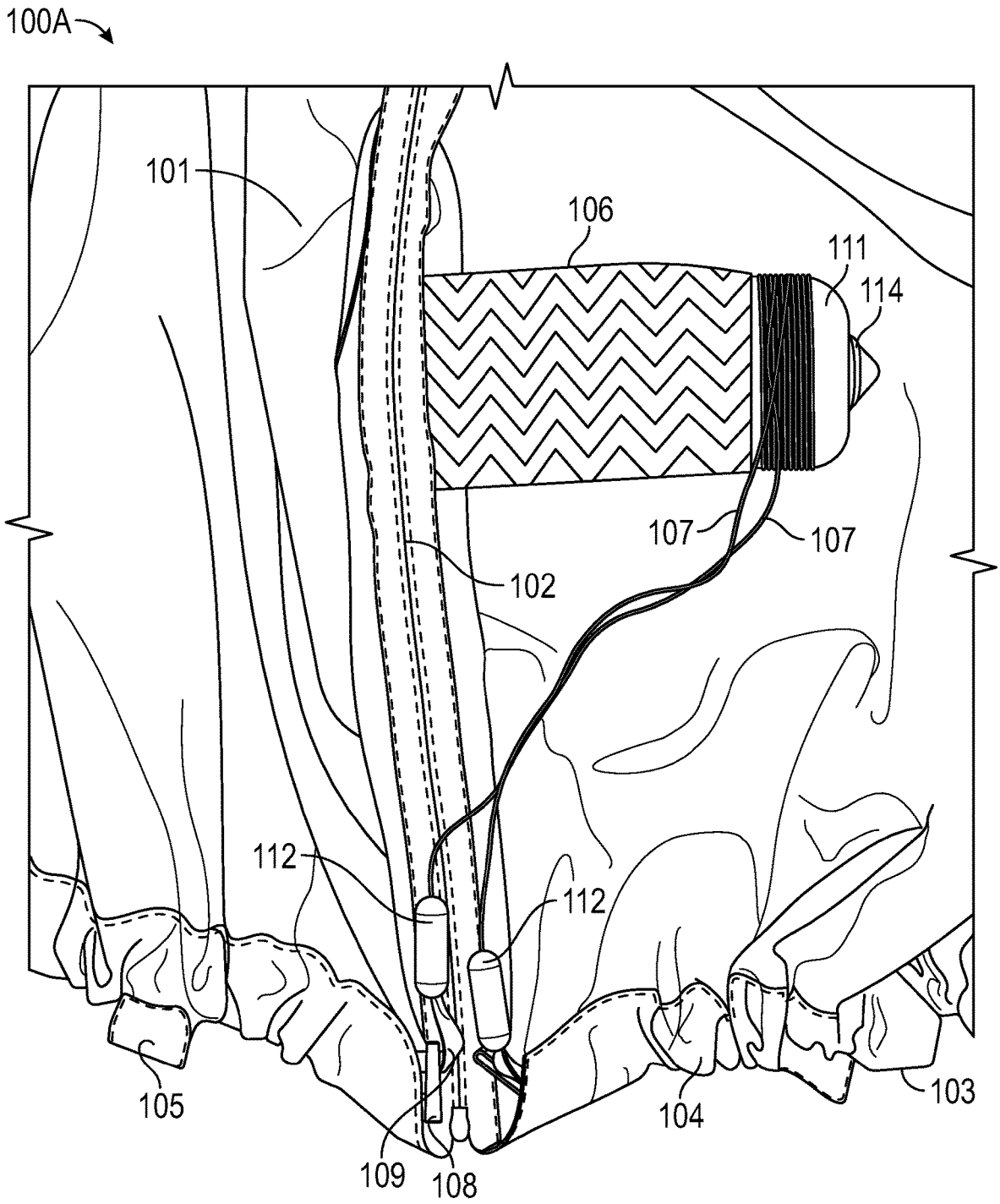
FIG. 7 is a second close-up view of a corner of the underside of the flat-fold fitted sheet in the closed position.

FIG. 7 illustrates a corner in the closed and drawn position of the underside of the sheet. The short sides 101 are connected via a zipper 102 being adhered to each other bringing together two short sides 101 of a corner and two long sides 103 to create a continuous piece of fabric forming a fitted sheet ready to be used on a mattress (not shown). Tabs 105 may be connected to the long sides 103. The string 107 has been used to draw the elastic 109 out from the casing 104. The ends of the elastic 109 are tethered to the sheet via the clasp 108 and capsule 112 fastening system. This leaves a long portion of string 107 free. To keep the string 107 from being tangled and loose or hanging, a spindle 111 is employed, wherein the string 107 may be wound around the spindle 111. A tie or spindle cord 114 may be employed to hold the string in place. A pocket 106 serves to hold the spindle 111 when the flat-fold fitted sheet is in use on a mattress. Alternately, another type of string 107 holding device or means may be employed. This means may be a retractable device or other mechanism for holding a length of string 107.

Figure 8:
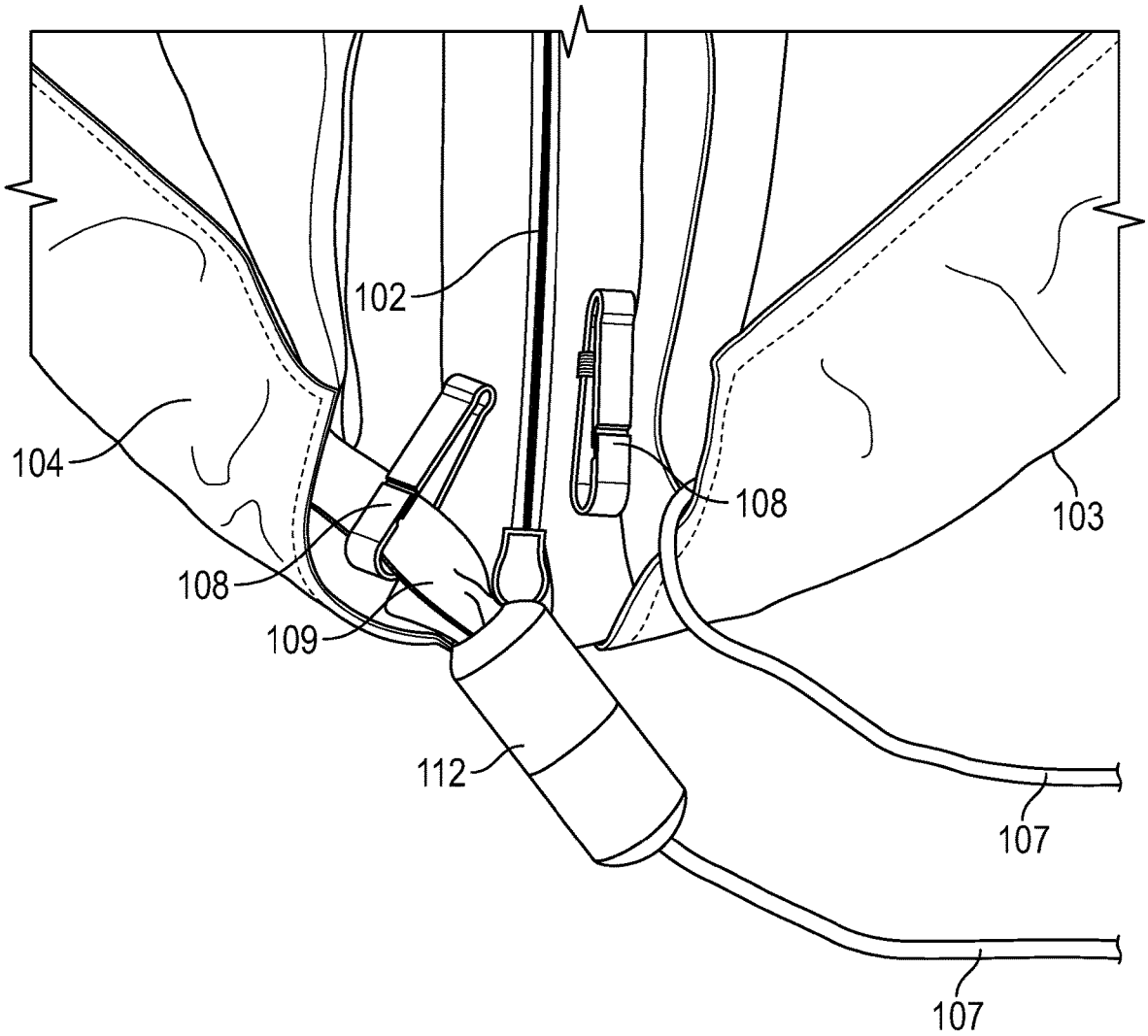
FIG. 8 is a close-up view of a corner of the underside of the flat-fold fitted sheet showing the elastic and string connection covered by capsule.

FIG. 8 shows a close-up view of the capsule 112 that holds the string 107 to elastic 108 connection. The capsule covers or contains the junction between the string 107 and elastic 108 that is threaded through the casing 104 on the long sides 103. The capsule 112 serves in part to allow the junction to slide through the casing with ease. The other end of the elastic is sewn or tethered to a far corner (not shown). The capsule 112 may be metal, plastic, or other appropriate material. The shape of the capsule 112 shown here should not be limiting in that one may envision any elongated device that fits over the tied or tethered ends of the string 107 and elastic 109 to serve the same purpose including another type of rounded or flat elongated sleeve device. This capsule 112 or other housing device may have a hole on either end, one for the elastic 109 to fit through and one for the string 107. A clasp 108 or other tethering device serves to hold the capsule 112 in place when the sheet is in the drawn position with zipper 102 closed and elastic 109 drawn tight.

Figure 9A:
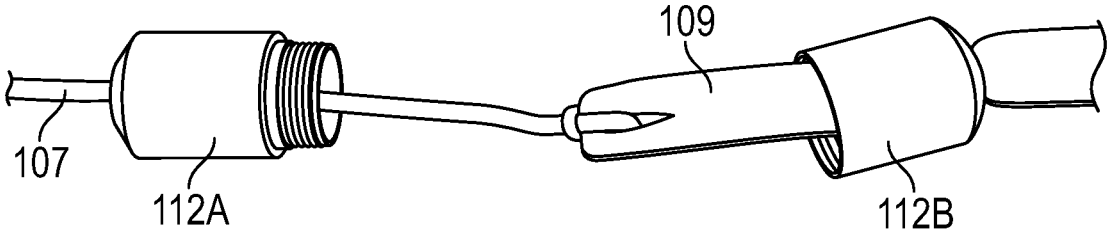
FIG. 9A is an example of the connection between the string and elastic.
Figure 9B:
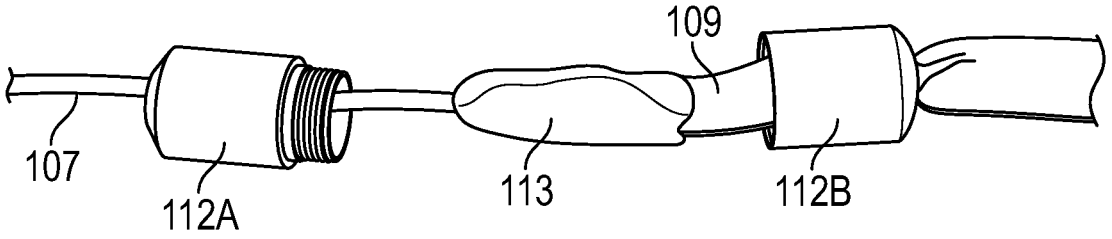
FIG. 9B is a further example of the connection between the string and elastic.

As shown in FIG. 9A, the capsule 112 or other housing device may be made of two separate pieces, being a male connector 112A and a female connector 112B, that fit together. The male connector 112A and female connector 112B may have holes on either end, one for the elastic 109 to fit through and one for the string 107 to fit through. Inside the capsule 112, the elastic 109 could be pulled through the hole in one end and the string 107 could be pulled through the hole in the other end, and the elastic 109 and string 107 could be knotted to one another before fitting the two sides of the capsule together. Alternately the capsule 112 or housing device may connect the string 107 and elastic 109 by tying knots in each after threading through their respective holes in the capsule such that pulling on the elastic 109 would cause the capsule to move through the casing 104 in one direction and pulling on the string 107 would cause the capsule to move through the casing 104 in the opposite direction. One may envision other means for connecting the string 107 and elastic 109 such as by stitching or adhesive. As shown in FIG. 9B, the knot that ties the elastic 109 to the string 107 could be reinforced with an epoxy clay 113, glue, resin, or other adhesive means such as tape, Velcro, snaps, buttons, or stitching. The capsule 112 may be comprised of two parts that fit together 112A, 112B, or may be one piece. Alternately, the elastic 109 and string 107 may be attached prior to fitting in a housing device. The capsule device may serve a dual purpose as shown in FIG. 8. The capsule 112 may serve to anchor the elastic 109 end to the clasp 108 such that the elastic will not slide back into the casing 104.

Figure 10:
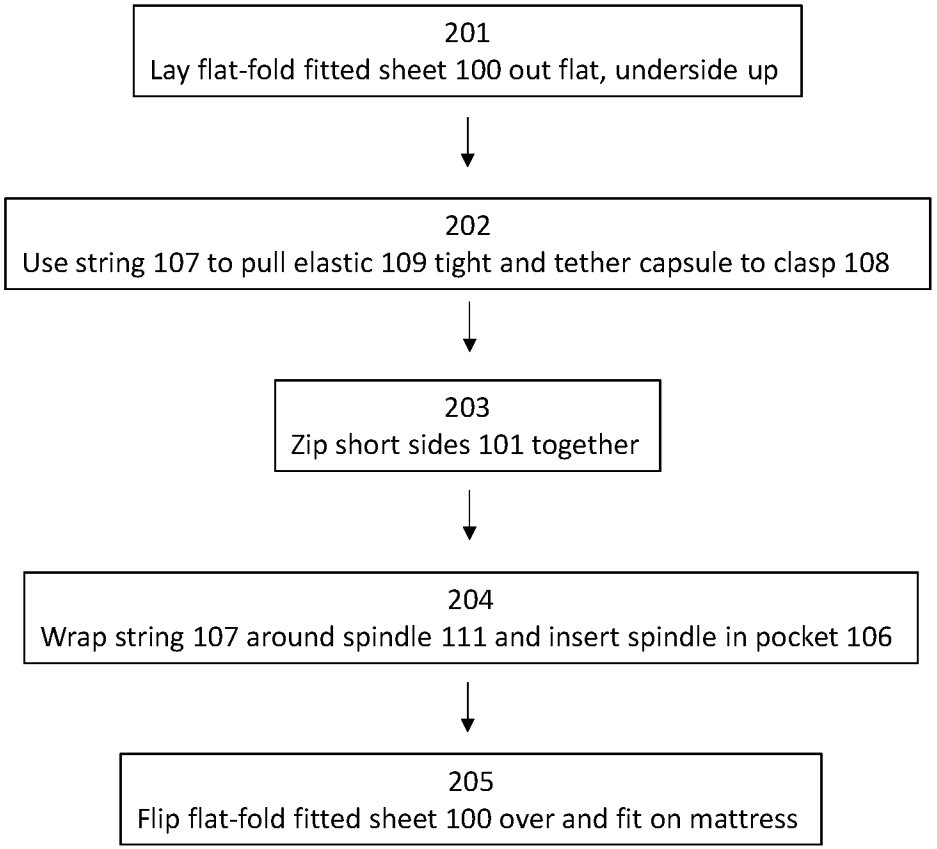
FIG. 10 is a flow chart of a method of using the flat-fold fitted sheet.

As outlined in FIG. 10, the flat-fold fitted sheet 100, may be used to cover a mattress in the following way. In step 1 201, the flat-fold fitted sheet 100 may be laid out, underside 100A up. In step 2 202, the string 107 may be pulled to move the capsule 112 through the casing 104. The capsule 112 may be tethered in place by hooking the clasp 108 over the elastic and/or string. Step 3, 203, zip the short sides 101 together. It may be envisioned that steps 202 and 203 may be switched in order. The closed or drawn position is now achieved. The extra string 107 may be wrapped around the spindle 111, and the spindle inserted in the pocket 106 in the next step 204. For the final step, 205, the flat-fold fitted sheet 100 may be turned over and placed on a mattress. To transform the flat-fold fitted sheet 100 from the closed to the open position these steps, 201, 202, 203, 204, and 205 may be done in reverse. First remove the spindle 111 from the pocket 106 and unwind the string 107. Next, untether the end of the elastic 109 from the clasp 108. Then unzip the corners. Next, allow the elastic 109 and string 107 to move through the casing 104. You may aid this process by smoothing the string 107 through the casing 104 or using the tabs 105 to pull the sheet 100 out flat. Once the sheet 100 is laid out flat it can be folded as desired into a flat shape.

To manufacture the disclosed flat-fold fitted sheet 100, the following steps may be employed and FIGS. 1-9B referenced. No particular order is perceived for most steps performed, however to start, a rectangular span of fabric is formed or acquired. As shown in FIG. 1, corners are cut to expose short sides 101 of the flat-fold fitted sheet 100. Mating sides of zippers 102 are sewn to these short sides 101. Edges of the long sides 103 are folded over to create casing 104. Alternately an extra span of fabric may be sewn to long side 103 edges to create casing 104. Tabs 105 may be sewn to the edges of the long sides 103. Pockets 106 may be sewn on the underside 100A of the flat-fold fitted sheet 100 near zipper 102 on at least one corners, or at least two corners. Elastic may be threaded through casing and tethered at two corners. The opposite end of the elastic to that tethered may be mated to string as shown in FIGS. 9A and 9B. A capsule 112, as shown in FIGS. 9A and 9B may be fit over the string-elastic junction. Clasps 108, FIG. 8 may be sewn or otherwise attached near zippers 102 to hold capsules 112 in place. A spindle 111, FIG. 6 or other retractable device may be fashioned or employed to hold string when the flat-fold fitted sheet is drawn into the closed position as shown in FIGS. 3 and 4. Various methods of manufacture are envisioned including hand cutting and sewing, machine cutting and sewing, and automated manufacture means.

EXAMPLE

Sample directions for making a king size flat-fold fitted sheet may include the following steps.

1. Cut rectangular piece of fabric that is 95" in length and 92" in width.
2. Cut a 15"×15" square from each corner.
3. Fold over long sides to create casings. (The casing should be 2.5-3 times the width of the elastic). Alternately, fabric can be added for casings.
4. Fold back a small triangle of fabric at the end of the casings that are adjacent to two diagonally opposite corners (allowing the elastic-string element to escape).
5. Sew zippers and spindle pockets into the two corners that have triangles of fabric left open (from step 4).
6. Sew zippers into the short sides of the other two corners.
7. Cut four segments of elastic, two 30" and two 34". Cut two segments of string that are 110" each. Thread one end of 30" elastic through hole at top of female side of capsule. Tie same end of elastic to one side of sting. Thread opposite side of string through large opening of male side of capsule, fitting string through the small hole at top. Pull male side of capsule near elastic-string knot (do not screw the two sides together). Next, thread string through small hole in male side of second capsule and leave near the top of string. Thread one end of 34" segment of elastic through hole at top of female side of second capsule. Tie string to the 34" span of elastic. Repeat this process at the diagonally opposite corner using the remaining spans of elastic and string.
8. Apply clay epoxy over both knots between string and elastic.
9. Screw female and male sides of capsules together over respective knots.
10. Using a drawstring threader, thread loose end of 30" elastic-string segment through the open end of 77" casing, tethering it to the far end by sewing it along the seam (inside the casing). Again, using a drawstring threader, thread the opposite end of elastic-string through the adjacent casing, anchoring it to the adjacent, 82" casing by sewing it along the far seam (inside the casing).
11. Sew closure elements along the zipper seams, just outside of the triangular casing openings from step 5 (to tether capsules).
12. Sew tabs to all four long sides (optional).
13. King size sheet is complete.

Although the present disclosure has been described with reference to the disclosed embodiments and example, numerous modifications and variations can be made and still the result will come within the scope of the disclosure. No limitation with respect to the specific embodiments disclosed herein is intended or should be inferred. Each apparatus embodiment described herein has numerous equivalents.

What is claimed is:

1. A flat-fold fitted sheet comprising:

a) a piece of fabric having a shape of a polygon with twelve sides, wherein the polygon is a concave dodecagon having four internal angles of 270° each and eight internal angles of 90° each, having two sets of two sides with each set having equal length, and another set of eight sides, the eight sides having equal length;

b) at least four zippers;

c) a casing on the two sets of two sides;

d) at least one span of an elastic cord, wherein the elastic cord is threaded through the casing and tethered at one location;

e) at least one single span of string with each end attached to a non-tethered end of the elastic cord; and f) at least one means to secure the elastic cord near the non-tethered end at at least one corner.

2. The flat-fold fitted sheet of claim 1 further comprising at least one means to house the string when the elastic cord is drawn into a closed position.

3. The flat-fold fitted sheet of claim 1 further comprising a second span of elastic cord and a second span of string.

4. The flat-fold fitted sheet of claim 3 comprising at least two means to house the second span of string when the second span of elastic cord is drawn into a closed position.

5. The flat-fold fitted sheet of claim 4 further comprising at least three means to secure the ends of the two spans of string and elastic cord at at least three corners.

6. The flat-fold fitted sheet of claim 1 further comprising tabs on at least one edge of at least one side of the two sets of two sides.

7. The flat-fold fitted sheet of claim 1, wherein the means to secure the ends of the elastic cord is a clasp.

8. The flat-fold fitted sheet of claim 1, wherein the means to house the string when the elastic cord is drawn into a closed position is a spindle.

9. The flat-fold fitted sheet of claim 1 further comprising a pocket as one means to hold a spindle.

10. The flat-fold fitted sheet of claim 1, wherein the means to house the string when the elastic cord is drawn into a closed position is a retractable device.

11. The flat-fold fitted sheet of claim 1, wherein the zippers are fitted to four pairs of the set of eight sides that temporarily fix one side of the pair to the other.

12. The flat-fold fitted sheet of claim 1 further comprising a housing covers a junction between the string and the elastic cord.

13. The flat-fold fitted sheet of claim 1, wherein the string attached to the two ends of the elastic cord from adjacent casings is long enough to remain slack when released and in an open position.

14. A flat-fold fitted sheet comprising:

a) a piece of fabric formed from a rectangular shaped span having four sides, two of which are longer, wherein corners have been removed to form a concave dodecagon with four interior angles of 270° each and eight internal angles of 90° each;

b) four zippers that serve to temporarily attach edges where the corners were removed;

c) casing on the four sides;

d) two spans of elastic cord each threaded through two sides of the casing and attached at one side along the zipper;

e) a single string attached to each loose end of the two spans of elastic cord;

f) a means to secure the ends of the elastic cord at four corners; and g) two means to house the strings when the elastic cords are drawn into a closed position.

15. The flat-fold fitted sheet of claim 14 further comprising tabs on the edges of the two sets of two sides.

16. The flat-fold fitted sheet of claim 14, wherein the means to secure the ends of the elastic cord is a clasp.

17. The flat-fold fitted sheet of claim 14, wherein the means to house the string when the elastic cord is drawn into the closed position is a spindle.

18. The flat-fold fitted sheet of claim 17 further comprising at least one pocket to house the spindle.

19. The flat-fold fitted sheet of claim 14, wherein the means to house the string when the elastic cord is drawn into a closed position is a retractable device.

20. The flat-fold fitted sheet of claim 14 further comprising a housing over a junction where the string is attached to the elastic cord.

* * * * *